US005338333A

United States Patent [19]

Uda et al.

[11] Patent Number: 5,338,333

[45] Date of Patent: Aug. 16, 1994

[54] PRODUCTION OF POWDERY INTERMETALLIC COMPOUND HAVING VERY FINE PARTICLE SIZE

[75] Inventors: Masahiro Uda; Yoshikazu Morita; Katsuhisa Oosaki, all of Chiba, Japan

[73] Assignee: Nisshin Steel Co., Ltd., Tokyo, Japan

[21] Appl. No.: 941,278

[22] Filed: Sep. 4, 1992

[51] Int. Cl.[5] ..... B22F 9/00

[52] U.S. Cl. ..... 75/352; 75/343; 420/900

[58] Field of Search ..... 75/352, 343; 420/900

[56] References Cited

U.S. PATENT DOCUMENTS

| | | | |
|---|---|---|---|
| 4,565,686 | 1/1986 | Kumar | 423/644 |
| 4,637,927 | 1/1987 | Komatsu et al. | 423/644 |
| 4,639,363 | 1/1987 | Komatsu et al. | 423/644 |

OTHER PUBLICATIONS

Misawa et al Jour Less-Common Metals, 89 (1983) 19-25.

Schulze et al Jour Less-Common Metals 139 (1988) 97-106.

*Primary Examiner*—Upendra Roy

*Attorney, Agent, or Firm*—Nikaido, Marmelstein, Murray & Oram

[57] ABSTRACT

An intermetallic compound such as $Nb_3Al$ exhibits the phenomenon of self-disintegration, when hydrogen is adsorbed in the intermetallic compound. This self-disintegration is used for the pulverization of the intermetallic compound material. The material is autogeneously pulverized into very fine particles only by adjusting an atmosphere to which the material is exposed, since the pulverizing reaction occurs between hydrogen existent in the atmosphere and the active surface of the intermetallic compound. The pulverized intermetallic compound having irregular shapes and large specific surface area is useful in various technical fields, e.g. as a superconductive material, a heat-resistant material, a magnetic body or a hydrogen-absorbing material.

2 Claims, 5 Drawing Sheets

● COMPOSITION CAPABLE OF PULVERIZATION

○ COMPOSITION INCAPABLE OF PULVERIZATION

RANGE WHERE PULVERIZATION OCCURED

● COMPOSITION CAPABLE OF PULVERIZATION

○ COMPOSITION INCAPABLE OF PULVERIZATION

RANGE WHERE PULVERIZATION OCCURED

PRODUCTION OF POWDERY INTERMETALLIC COMPOUND HAVING VERY FINE PARTICLE SIZE

BACKGROUND OF THE PRESENT INVENTION

The present invention is related to a method for producing a powdery intermetallic compound having particle size of a few to tens μm.

Powderized metallic material has been used for manufacturing a product having an objective configuration by a sintering method or the like. A proper metal working process may be applied to a sintered body to be formed into a final shape. The same metal powder has been used as additives to resin or rubber compositions for manufacturing electric conductive paint, a magnet volt, etc. Such powdery metallic material has been prepared by mechanical crushing, oxidation-reduction, atomizing, etc.

For instance, a powdery intermetallic compound $Nb_3Al$ useful as a superconductive material is prepared from an alloy bulk having the same composition as an objective composition by a plasma rotary electrode method, HDHP process using reducing reaction with hydrogen, etc. The powdery intermetallic compound $Nb_3Al$ may be prepared by a mechanical alloying process wherein pure Nb powder is alloyed with pure Al powder by mechanical stirring.

A powder metallurgy process is suitable for manufacturing a product comprising a high-melting point intermetallic compound, as compared with a melting process. In this consequence, it is required to offer finely powderized material at a low cost with high productivity. However, it is difficult to obtain a powdery product having uniform composition and proper particle size distribution with high productivity according to the conventional powderizing methods. In addition, some of the conventional methods need a huge cost of equipment.

In case where a finely powderized intermetallic compound is to be produced by the plasma rotary electrode method, it is difficult to prepare a rotary electrode made of the intermetallic compound due to the brittleness of raw material. That is, there is a problem to be overcome for adopting the plasma rotary electrode method in a mass production line. In addition, the powder obtained by this method has particle size distribution over such a broad range that the powder being compressed exhibits poor compactibility. As a result, it is difficult to obtain a compressed powdery body or a sintered body having high density.

It is reported that powdery intermetallic compound $Nb_3Al$ can be pulverized by applying mechanical impact force to the alloy bulk which has adsorbed hydrogen therein (see Journal of the Less-Common Metals, 158 (1990) p. 71–79 and 139 (1988) p. 97–106). The intermetallic compound particles are reformed into the state of brittle hydride by the adsorption of hydrogen. The brittle hydride can be crushed into finely pulverized state by mechanical impact force. According to this method, a raw material to be used must have very fine particle size, since the adsorption of hydrogen is necessary to make the raw material brittle. Consequently, the finely pulverized product is not obtained with high productivity. In addition, expert skill is required for the manufacturing process.

SUMMARY OF THE PRESENT INVENTION

An object of the present invention is to overcome the problems in the abovementioned conventional methods.

Another object of the present invention is to obtain finely pulverized intermetallic compound having uniform particle size within the range of a few to tens μm without the necessity of special mechanical or thermal energy.

Still another object of the present invention is to crush a raw material into finely pulverized state only by the adjustment of an atmosphere.

These objects are attained by using the phenomenon that an intermetallic compound bulk containing a defined element disintegrates itself after the adsorption of hydrogen. This phenomenon is newly found out by the inventors of the present invention. Using this phenomenon, the intermetallic compound bulk can be pulverized into fine particles only by subjecting the alloy bulk to a controlled atmosphere.

According to the present invention, the raw material of intermetallic compound containing the Group III-a, IV-a or V-a metal on Periodic Table as a main component is prepared in the active state that its surface is free from oxide films. The raw material is then held in contact with a hydrogen atmosphere or a hydrogen containing atmosphere.

In order to obtain the raw material having the surface free from oxide films, the raw material is melted and solidified in a non-oxidizing atmosphere. Even when an available raw material is in the state that there is already formed an oxide film thereon, the active metallic surface can be prepared by dividing or cracking the raw material.

The raw material of the intermetallic compound which can be pulverized by the adsorption of hydrogen contains Group III-a, IV-a or V-a metal such as La, Nd, Zr, Nb and Ta as a main component. The second component, which does not restrict the scope of the present invention at all, may be Ge, Sn, Fe, Ni, Al, Si etc.

DETAILED DESCRIPTION OF THE PREFERRED EMBODIMENTS

Figure 1:
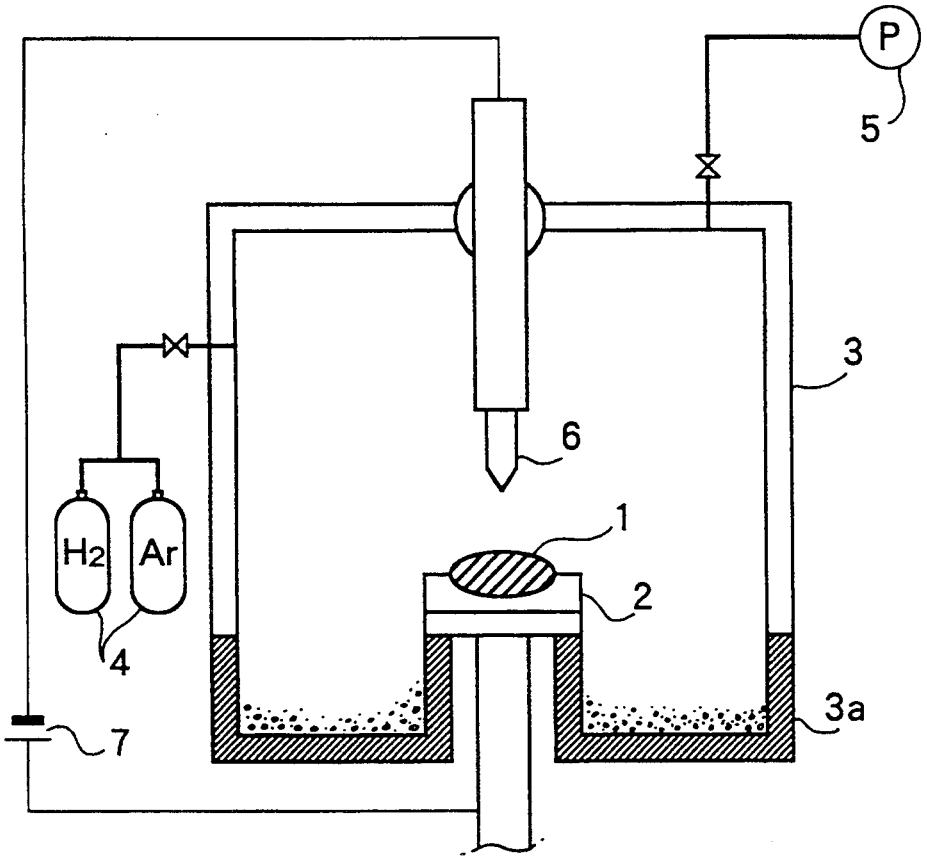
FIG. 1 is a schematic diagram for an arc-melting furnace used in the examples of the present invention.

The intermetallic compound $Nb_3Al$ has the property to become brittle after the adsorption of hydrogen, as reported in Journal of the Less-Common Metals, 158 (1990) p. 71–79 and 139 (1988) p. 97–106. However, the amount of hydrogen to be adsorbed in the intermetallic compound $Nb_3Al$ is limited. The embrittled intermetallic compound supports its configuration as such without being disintegrated, under the condition that mechanical impact force is not applied to the intermetallic compound. That is, the mechanical impact force is necessary to crush the intermetallic compound into finely pulverized state.

In this sense, the self-disintegration phenomenon, on which the present invention is based, is fundamentally different from the application of the mechanical impact force to pulverize the intermetallic compound. The self-disintegration phenomenon was unexpectedly discovered, in the inventors' work to research and investigate the physical properties of the intermetallic compound.

The intermetallic compound $Nb_3Al$ has a surface onto which a tough oxide film is firmly bonded. Due to this oxide film, the adsorption of hydrogen in the conventional methods occurs only through pinholes or other defects in the oxide film. Whether or not hydrogen is adsorbed in the intermetallic compound mainly depends on the condition of the oxide film. For instance, when a very thick and tough oxide film is formed on the surface of the intermetallic compound, hydrogen is scarcely adsorbed in the intermetallic compound.

On the other hand, when the intermetallic compound $Nb_3Al$ having a surface condition free from oxide film is subjected to a hydrogen atmosphere or a hydrogen containing atmosphere, the adsorption of hydrogen advances at an extremely high speed. In consequence of the adsorption of hydrogen, the scattering of fine particles is observed on the surface of the intermetallic compound.

The relationship of the rapid hydrogen adsorption with the activity of the surface is recognized by the fact that rapid hydrogen adsorbing reaction occurs on the newly exposed surface when an intermetallic compound bulk is divided by mechanical force in a hydrogen atmosphere or a hydrogen containing atmosphere. The hydrogen adsorbing reaction stops after the formation of an oxide film by the reaction of the intermetallic compound $Nb_3Al$ with oxygen contained as an impurity in the atmosphere. When the intermetallic compound bulk on which the oxide film has been formed is divided, a new active surface is exposed to the atmosphere. Consequently, the hydrogen adsorbing reaction is restarted on the newly exposed active surface. The adsorption of hydrogen may be restarted by cracking the surface of the intermetallic compound to expose the new active surface.

The power of the active metal surface to adsorb hydrogen is not limited to the intermetallic compound $Nb_3Al$. The same phenomenon is observed as for other intermetallic compounds containing Group III-a, IV-a and V-a metals, e.g. La, Nd, Zr, Nb and Ta, as a main component. It is also recognized that intermetallic compound containing Ge, Sn, In or Ga as a secondary component instead of Al exhibits the same self-disintegration after the adsorption of hydrogen. In response to the kind of the main component, the hydrogen adsorbing reaction resulting in self-disintegration becomes relatively slow. When the reaction is slow, the interface reaction between the active metal surface and hydrogen may be accelerated by changing the temperature and/or the hydrogen potential of the atmosphere.

In order to promote the self-disintegration derived from the adsorption of hydrogen with high efficiency, the amount of Group III-a, IV-a or V-a metal is preferably maintained in a proper range in response to the type of the intermetallic compound. For instance, as for the Nb-Al type to which three intermetallic compounds $Nb_3Al$, $Nb_2Al$, $NbAl_3$ belong, the self-disintegration occurs more actively out as the increase of Nb content. The same self-disintegration useful for industrial application is recognized on $NbGe_3$ in Nb-Ge type, $Nb_3Sn$ in Nb-Sn type, $Nb_3Ga$ in Nb-Ga type and $Nb_3Si$ in Nb-Si type. The reason why the self-disintegration occurs vigorously within this range of Nb content is not sure, but probably owing to the change of crystal lattice when hydride is formed.

Some of the intermetallic compounds exhibit relatively slow self-disintegrating reaction. In this case, the hydrogen adsorbing reaction may be activated to accelerate the self-disintegration by changing the temperature of the hydrogen atmosphere or the hydrogen containing atmosphere or the temperature of the intermetallic compound material itself. For instance, the self-disintegration of $Nb_3Al$ can be accelerated by holding $Nb_3Al$ at a temperature lower than a room temperature.

The intermetallic compound finely pulverized by the adsorption of hydrogen is in hydride state. Dehydrated fine intermetallic compound powder is obtained from the hydride by heating it at a high temperature in vacuum. The obtained intermetallic compound powder may be repeatedly subjected to the hydrogen adsorption and dehydration to manufacture a powdery product having much smaller particle size.

For preparing the raw material of the intermetallic compound having active surface, raw components suitable for the intermetallic compound having a predetermined composition may be melted in a non-oxidizing atmosphere. For instance, a copper crucible equipped with a water cooling jacket is located in an arc-melting furnace filled with Ar, and raw materials for the intermetallic compound are arc-melted. The atmosphere may contain hydrogen to inhibit the oxidation of the raw material during melting and to remove oxides from the raw materials. When the molten intermetallic compound $Nb_3Al$ becomes into the state having a uniform composition by the melting, arc discharge is stopped. The molten intermetallic compound $Nb_3Al$ is rapidly cooled and solidified by the diffusion of heat through the copper crucible.

The intermetallic compound $Nb_3Al$ cooled to a room temperature exhibits excellent hydrogen adsorbing property. Hereon, the chamber in which the copper crucible is located is evacuated and then filled with hydrogen up to the atmospheric pressure. As a result, the intermetallic compound $Nb_3Al$ begins the hydrogen adsorbing reaction and is pulverized into fine particles by the self-disintegration. The hydrogen adsorbing reaction becomes more vigorous as the increase of hydrogen content in the atmosphere.

The finely disintegrated powder being in hydride state is dehydrated by heating it at a high temperature in vacuum. The hydrogen adsorbed in the powder is discharged by the vacuum heating, so as to obtain finely pulverized intermetallic compound. The vacuum heating is performed at a different temperature in response to the kind of the intermetallic compound. For instance, the intermetallic compound $Nb_3Al$ having adsorbed hydrogen is heated at 800° C. or so to be sufficiently dehydrated.

According to the present invention, a finely pulverized intermetallic compound is obtained under the condition that an arc-melted material is held as such in an arc furnace, only by changing an inert gas atmosphere during arc-melting to a hydrogen atmosphere or a hydrogen containing atmosphere during the pulverization. The pulverized particles have irregular shapes and large specific surface area, since the intermetallic compound is pulverized into very fine particles by self-disintegration. Owing to these physical properties, the disintegrated powder has high activity and excellent compactibility. The obtained very fine intermetallic compound powder is useful as superconductive material, heat resistant material, magnetic material, hydrogen-adsorbing material, etc. using its excellent properties.

The other features of the present invention will be apparent from the following examples, wherein the present invention is applied to the production of some intermetallic compound having fine particles. However, the examples do not have any restrictions on the scope of the present invention, and the other intermetallic compounds maybe of course finely pulverized in the same way.

EXAMPLE 1

An arc-melting furnace having the equipment construction as shown in FIG. 1 was used in this example. Raw intermetallic compound materials 1 to be melted were inserted in a copper crucible 2 equipped with a water cooling jacket, and the copper crucible 2 was disposed in the arc-melting furnace. The arc-melting furnace had a furnace body 3 and a recovery part 3*a* detachably attached to the lower part of the furnace body 3. The recovery part 3*a* had a double wall in which a water cooling jacket was incorporated. Inert gas, hydrogen gas or the like was introduced from a gas vessel 4 into the arc-melting furnace. The interior of the arc-melting furnace was evacuated by a vacuum pump 5 and then charged with proper inert gas or hydrogen gas to maintain a non-oxidizing atmosphere or a hydrogen atmosphere in the arc-melting furnace.

In the arc-melting furnace, a tungsten electrode 6 was located at a position opposing to the copper crucible 2. A predetermined electric potential was charged between the tungsten electrode 6 and the copper crucible 2 from a D.C. power source 7. The raw materials 1 were exposed to the irradiation of a resulting arc, and melted in the copper crucible 2 by the arc heat.

A powdery mixture of 18 g Nb and 2 g Al was used as the raw intermetallic compound materials 1. The powdery mixture was inserted in the copper crucible 2 and preset in the arc-melting furnace held in the atmosphere of 5% $H_2$—Ar. The powdery mixture was arc-melted by applying an electric current of 300 A while charging a potential of 20 V between the copper crucible 2 and the tungsten electrode 6.

After the powdery mixture was completely melted, the power supply was stopped, and the interior of the arc-melting furnace was evacuated into vacuum. The molten material 1 was rapidly cooled and solidified by the diffusion of heat through the copper crucible 2. Pure hydrogen gas was then introduced into the arc-melting furnace, until the internal pressure reached atmospheric pressure.

Figure 2:
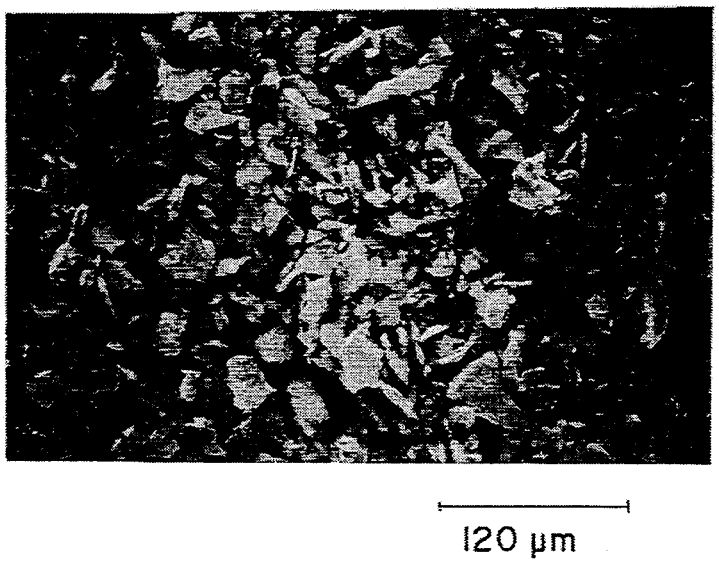
FIG. 2 is a microscopic photograph showing a finely pulverized intermetallic compound $Nb_3Al$ obtained in the example 1 of the present invention.
Figure 3:
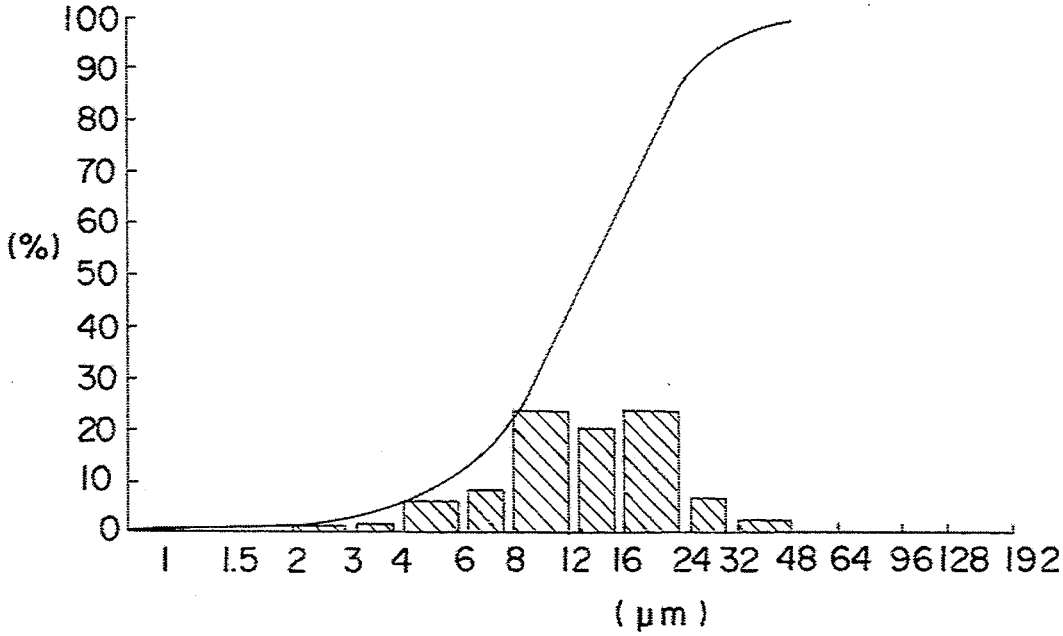
FIG. 3 is a diagram illustrating the particle size distribution of the same intermetallic compound.

The pulverization of the solidified intermetallic compound block violently began at the same time when hydrogen was introduced into the arc-melting furnace. The whole body of the intermetallic compound was completely pulverized in 60 min.. The obtained fine intermetallic compound powder was observed by Scanning Electron Microscope (SEM). The obtained powder had the structure shown in FIG. 2. It is noted from FIG. 2 that the obtained powder comprised irregularly formed particles having extremely large specific surface area. The obtained powder had the particle size distribution shown in FIG. 3. It is noted from FIG. 3 that the obtained powder had fine particle size of 13.1 μm in average.

Figure 4:
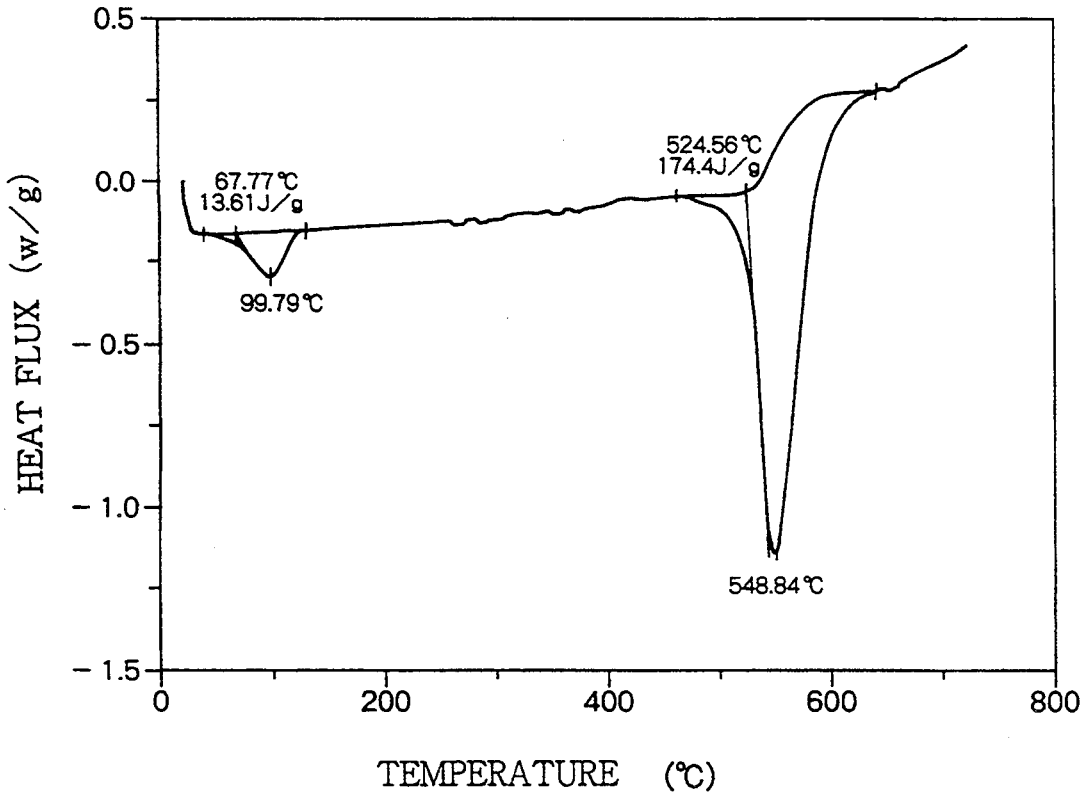
FIG. 4 is a diagram which represents the differential thermal analysis of the same intermetallic compound.

The interior of the arc-melting furnace was then evacuated into vacuum, and the intermetallic compound powder was heated up to 800° C. at a heating speed of 20° C./min. by the transmission of heat through the wall of the arc-melting furnace. In this heating step, the intermetallic compound powder exhibited the thermogram shown in FIG. 4. There is noted an active endothermic reaction in the temperature range of 500°-600° C. The endothermic reaction shown in FIG. 4 represents the dehydration of the intermetallic compound powder.

Figure 5A:
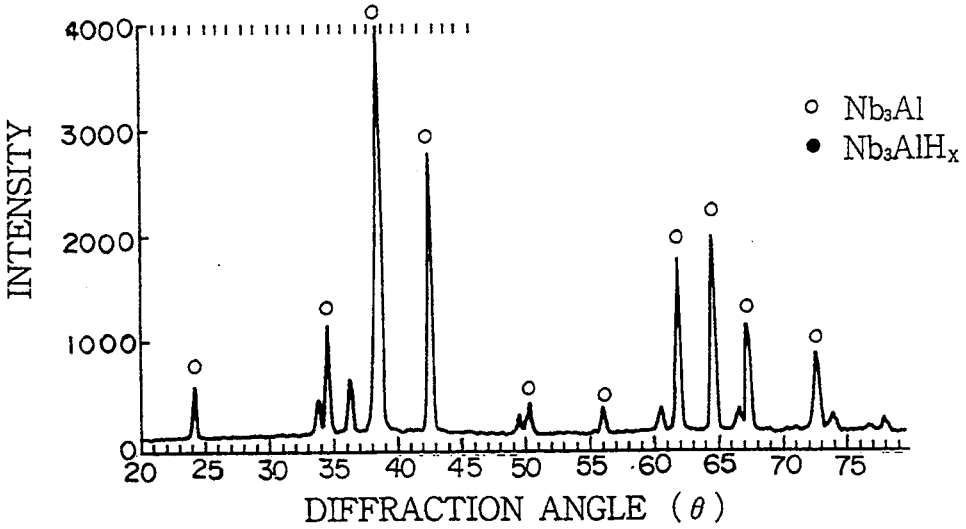
FIGS. 5(*a*) to 5(*c*) are diagrams for illustrating the X-ray diffraction patterns of an intermetallic compound bulk, hydride powder and dehydrated powder, respectively.
Figure 5B:
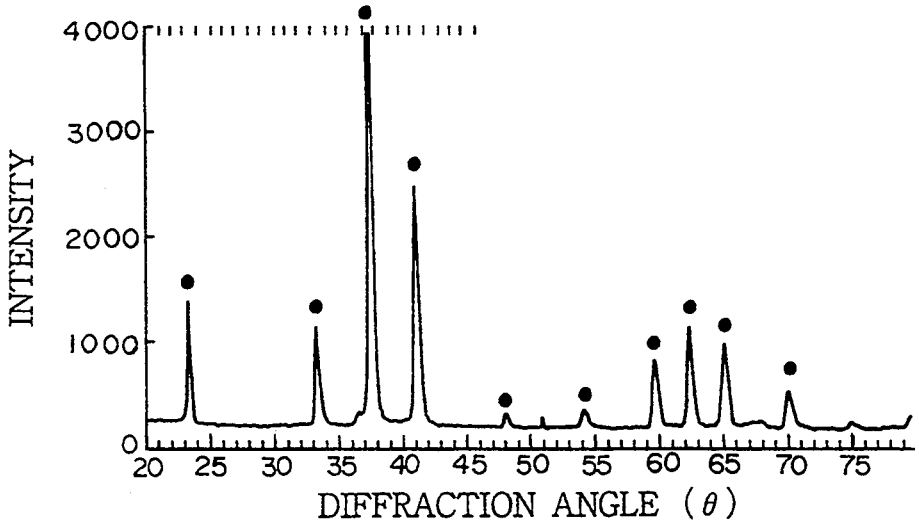
Figure 5C:
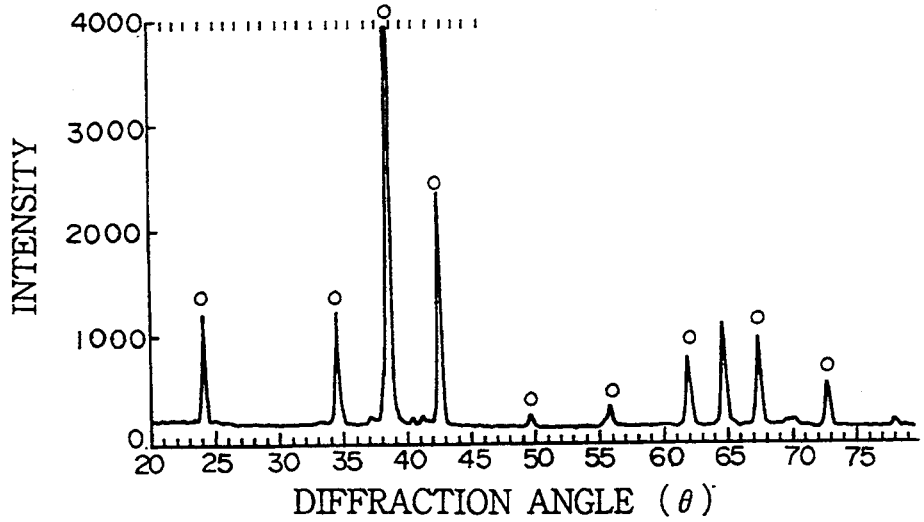

The raw material, the hydride powder and the dehydrated powder were investigated by X-ray diffraction method. The obtained X-ray diffraction patterns were shown in FIGS. 5(*a*) to 5(*c*), respectively. The intermetallic compound bulk prepared by arc-melting the powdery mixture of Nb and Al had X-ray diffraction pattern shown in FIG. 5(*a*), wherein it was noted a peak at an angle of diffraction representing $Nb_3Al$. The X-ray diffraction pattern changed into the state shown in FIG. 5(*b*), after hydrogen was adsorbed in the intermetallic compound bulk. By comparing FIG. 5(*a*) with FIG. 5(*b*), there is noted the deviation of a peak to a diffraction angle representing $Nb_3AlH_x$ formed by the adsorption of hydrogen. On the other hand, the intermetallic compound after being dehydrated had the X-ray diffraction pattern shown in FIG. 5(*c*). This X-ray diffraction pattern was substantially the same as that shown in FIG. 5(*a*). From the comparison of FIG. 5(*c*) with FIG. 5(*a*), it is apparent that the intermetallic compound powder after being dehydrated had the same composition as that of the intermetallic compound bulk just after being melted.

EXAMPLE 2

An intermetallic compound $Nb_3Al$ bulk prepared by the same arc-melting method as that in Example 1 was let alone as such for one week under the ambient atmospheric condition. The bulk was inserted in a closed chamber. The closed chamber was evacuated into vacuum, and then pure hydrogen was introduced into the closed chamber until the internal pressure reached the atmospheric pressure. Under this condition, there was not observed any change on the intermetallic compound bulk.

When the bulk was scratched to expose a fresh metallic surface, the intermetallic compound began pulverized from the scratched plane. As the advancement of the pulverization, many cracks were autogeneously formed in the intermetallic compound bulk so as to expose more active metallic planes. Consequently, the pulverizing reaction acceleratively advanced and finished in about 60 min.. The pulverized intermetallic compound was dehydrated. The obtained product comprised fine particles having a particle size of 13.0 μm in average and had the same composition as that of the intermetallic compound bulk prepared by the arc-melting.

From the example 2, it is understood that the surface of the intermetallic compound $Nb_3Al$ let alone in the atmosphere is coated with an oxide film which acts as an inhibitor to the hydrogen adsorbing reaction. When the oxide film is broken to expose an active metallic surface, hydrogen existent in the internal atmosphere starts the reaction with the intermetallic compound $Nb_3Al$. In consequence, the adsorption of hydrogen begins to bring out the phenomenon of self-disintegration.

EXAMPLE 3

The amount of hydrogen existent in the internal atmosphere to be used for the adsorption of hydrogen in the intermetallic compound was variously changed, to research the effect of the hydrogen content on the start of pulverization and the degree of pulverization. In this example, the same intermetallic compound $Nb_3Al$ material as that prepared in Example 1 was used as the intermetallic compound bulk. From this example 3, it was recognized that the self-disintegrating reaction of the intermetallic compound $Nb_3Al$ became more active as the increase of hydrogen content.

EXAMPLE 4

Figure 6:
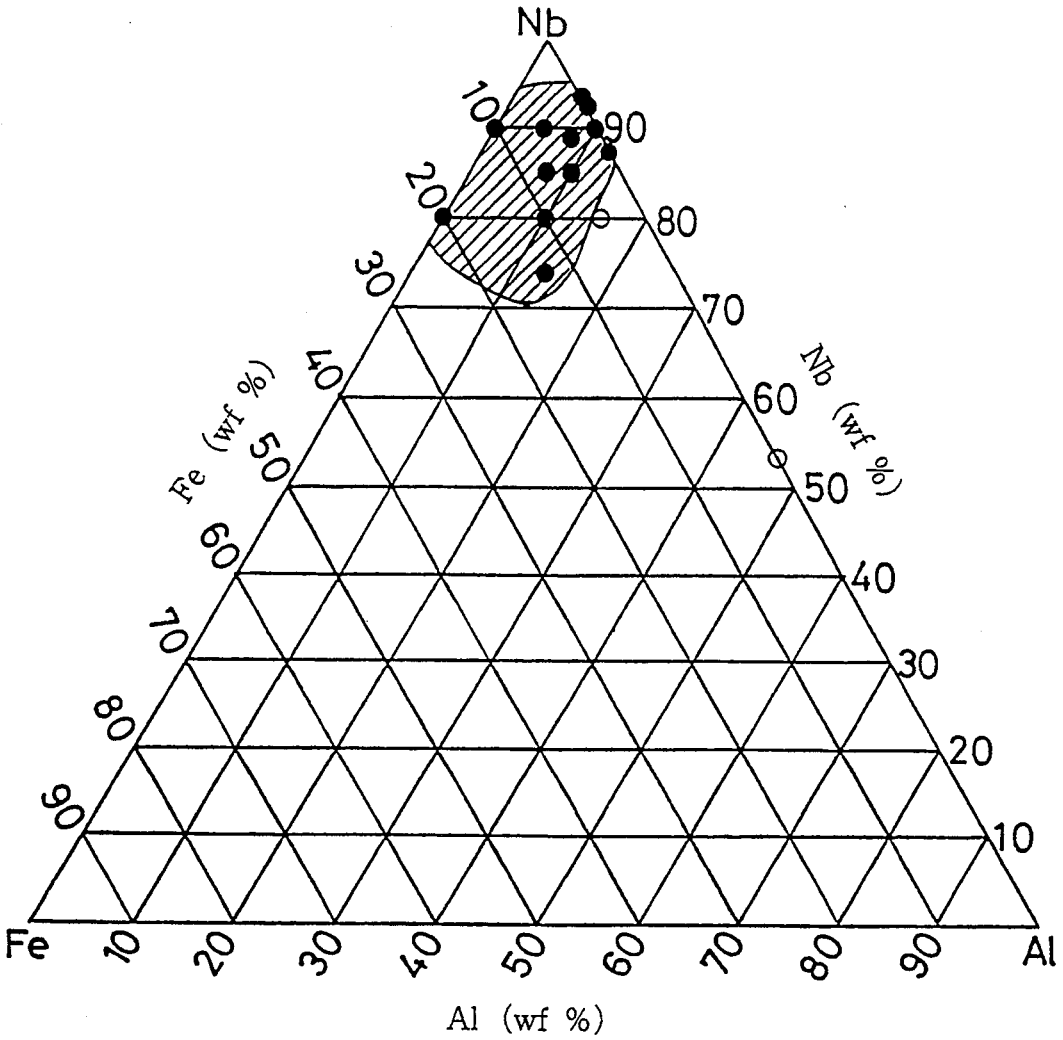
FIG. 6 is a diagram which shows the range of pulverizable composition in the Nb-Al-Fe ternary system.

Nb, Al and Fe materials were melted by the same arc-melting method as that in Example 1 to prepare intermetallic compound bulks having different compositions. The obtained bulks were held in contact with pure hydrogen at the atmospheric pressure of 1 bar. Some of the bulks were not pulverized by the self-disintegration. Whether or not the self-disintegration was observed depended on the composition. The range of the composition in the Nb—Al—Fe tertiary system where the self-disintegration occurred is shown as the hatched zone in FIG. 6. It is noted from FIG. 6 that the phenomenon of self-disintegration occurs mainly in the composition range containing Nb with high concentration.

EXAMPLE 5

There were prepared several intermetallic compounds by the same arc-melting method as that in Example 1, i.e. an intermetallic compound $Nb_3Si$ from 22.8 g Nb powder and 2.2 g Si powder, an intermetallic compound $Nb_3Ge$ from 20.4 g Nb powder and 5.1 g Ge powder, an intermetallic compound $Zr_3Si$ from 22.68 g Zr powder and 2.3 g Si powder, an intermetallic compound $Ta_5Si$ from 24.2 g Ta powder and 0.75 g Si powder, an intermetallic compound $Nd_2Fe_{14}B$ from 6.5 g Nd powder, 18 g Fe powder and 0.2 g B powder, and an intermetallic compound $LaNi_5$ from 8.17 g La powder and 17.5 g Ni powder, respectively.

Each of the obtained intermetallic compound bulks was subjected to self-disintegration by holding it in contact with pure hydrogen at 1 bar. A time period required for the completion of pulverization and a primary particle size at the completion of pulverization were different from each other in response to the kind of the intermetallic compound. The difficulty of pulverizing each intermetallic compound is shown in Table 1.

In Table 1, vigorous pulverization is shown as the mark ◎, easy pulverization is shown as the mark ○, and pulverization over a predetermined time period is shown as the mark Δ. As for the pulverizing process, the process A represents the pulverization in a pure hydrogen atmosphere at a room temperature followed by the removal of a coarse powdery fraction having a particle size of 100 μm or more using sieves. According to the process B, each intermetallic compound was slightly ground in a hydrogen atmosphere, since a coarse powdery fraction was formed in an amount exceeding 50% after pulverization in a pure hydrogen atmosphere at a room temperature under the atmospheric pressure of 1 bar.

TABLE 1

PULVERIZING TENDENCY OF EACH INTERMETALLIC COMPOUND

| KIND OF INTERMETALLIC COMPOUND | DIFFICULTY OF PULVERIZATION | PROCESS |
|---|---|---|
| $Nb_3Al_{0.7}Ge_{0.3}$ | ◎ | A |
| $Nb_3Si$ | ◎ | A |
| $Nb_3Ge$ | ○ | B |
| $Nb_3Sn$ | Δ | B |
| $Zr_3Si$ | ◎ | B |
| $Ta_5Si$ | ○ | A |
| $Nd_2Fe_{14}B$ | ○ | B |
| $LaNi_5$ | Δ | B |

The present invention as abovementioned utilize the newly found phenomenon that an intermetallic compound containing Group III-a, IV-a or V-a metal such as Nb as a main component exhibits the property of self-disintegration derived from the adsorption of hydrogen. Owing to the self-disintegration, the intermetallic compound is autogeneously pulverized into fine particles only by the simple adjustment of the environment. The obtained powder comprises fine particles having a sharp particle size distribution and an irregular shape effective in large specific surface area, as compared with powder obtained by mechanical stirring. In addition, super fine particles are easily obtained by the repetition of the adsorption of hydrogen followed by dividing or cracking bulks or particles to expose a new active plane. Thus, finely pulverized intermetallic compounds are manufactured with high productivity without the necessity of big-scale equipment.

While the preferred embodiment and examples of the present invention have been explained with reffering to the drawings, it is to be understood that this disclosure is for the purpose of illustration and that various changes and modifications may be made without departing from the scope of the invention as set forth in the appended claims.

What is claimed is:

1. A method of producing an intermetallic compound powder having a fine particle size comprising the steps of:

in an arc furnace, arc-melting at least one element selected from Nb, La, Nd, Zr and Ta together with at least one element selected from Ge, Sn, Fe, Ni, Ga, Al and Si under a non-oxidizing Ar gas atmosphere under conditions sufficient to form an intermetallic compound bulk material having a surface which is substantially free from oxide films, exchanging said Ar gas atmosphere for a non-oxidizing atmosphere comprising hydrogen, holding said intermetallic compound bulk material in said arc furnace under said atmosphere comprising hydrogen for a time and under conditions sufficient to cause said intermetallic compound bulk material to absorb sufficient hydrogen to cause at least a portion of said intermetallic compound bulk to become pulverized, and then dehydrating the resulting pulverized intermetallic compound by heating in a vacuum.

2. A method of producing an intermetallic compound powder having a fine particle size comprising the steps of:

in an arc furnace, arc-melting at least one element selected from Nb, La, Nd. Zr and Ta together with at least one element selected from Ge, Sn, Fe, Ni, Ga, Al ad Si under a non-oxidizing Ar gas atmosphere under conditions sufficient to form an intermetallic compound bulk material having a surface which is substantially free from oxide films, exchanging said Ar gas atmosphere for a non-oxidizing atmosphere comprising hydrogen, holding said intermetallic compound bulk material in said arc furnace under said atmosphere comprising hydrogen for a time and under conditions sufficient to cause said intermetallic compound bulk material to absorb sufficient hydrogen to cause at least a portion of said intermetallic compound bulk to become pulverized, dehydrating the resulting pulverized intermetallic compound by heating in a vacuum, and then alternatingly repeating said hydrogen adsorption/-pulverization and said vacuum dehydration to pulverize further portion of said intermetallic compound.

* * * * *